United States Patent [19]

Johnson

[11] Patent Number: 4,603,522

[45] Date of Patent: Aug. 5, 1986

[54] HINGEABLE CONNECTION DEVICE FOR THRU THE SLAB CONNECTIONS IN FOLDABLE BUILDING CONSTRUCTION

[76] Inventor: Delp W. Johnson, 240 Oakview Dr., San Carlos, Calif. 94070

[21] Appl. No.: 522,574

[22] Filed: Aug. 12, 1983

[51] Int. Cl.[4] ..... E04B 1/344; E04G 21/14

[52] U.S. Cl. ..... 52/125.4; 52/64; 52/745

[58] Field of Search ..... 52/64–71, 52/125.1–125.5, 79.5, 127.1, 127.3, 741, 745, 704, 583; 414/10, 11; 294/89

[56] References Cited

U.S. PATENT DOCUMENTS

| | | | |
|---|---|---|---|
| 3,744,196 | 7/1973 | Weese | 52/79.5 X |
| 3,855,744 | 12/1974 | Miram | 52/125.5 |
| 4,437,272 | 3/1984 | Johnson | 52/71 X |

*Primary Examiner*—J. Karl Bell

[57] ABSTRACT

A hingeable connection is disclosed for use in connecting wall slabs to ceiling slabs in foldable slab constructed buildings, which connection comprises an access hole thru the ceiling slab, which access hole is located over a hinged edge of an underlying wall slab, and an elongated connecting member which is inserted down thru the access hole to engage a pivot type connection secured to the underlying wall, and the vertical movement of the elongated connection member is restrained by the ceiling slab, so that when the ceiling slab is elevated, the underlying wall slab is elevated and brought to a dependent vertical position, and the vertical wall slab is placed upon a supportive floor, and the ceiling slab is lowered onto the wall and guided into position by the hingeable connection.

20 Claims, 33 Drawing Figures

HINGEABLE CONNECTION DEVICE FOR THRU THE SLAB CONNECTIONS IN FOLDABLE BUILDING CONSTRUCTION

BACKGROUND OF THE INVENTION

This invention relates to the hingeable connections required for the method of construction in which walls and ceiling slabs are cast horizontally on site and in which ceiling slabs are positioned over a group of wall slabs and the wall slabs are hingeably connected to the ceiling slabs from a position on top of the ceiling slab, by a hingeable connection which is inserted thru an access slot and attached to a pivot means secured in the hinge edge of the wall slab, and the connection provides for the clearance required to permit the end of the wall slab to rotate under the ceiling slab, and for the pick up of the weight of the wall slab, and the connection device provides for the guidance of the ceiling slab as it is lowered to bear on the upper edge of the wall slabs.

This method of construction is set forth in my copending application Ser. No. 519,082.

Hertofore connection devices for foldable concrete slab construction have been made as disclosed in Johnson U.S. Pat. No. 3,494,092 in which reinforcing bars were cast embedded continuously between ceiling and wall slabs and these bars were allowed to bend during the lifting operation. These bent bars were suitable for one story construction, and for conditions where the walls were cast in an outward position in the same plane as the ceiling slab. There were spalling problems however that required considerable expense to over come. In addition, the Engineers calculating the strength of the joint were not satisfied that the spalling could be completely overcome. In addition the transfer of vertical loading thru the joint was a problem. Johnson '092 disclosed the use of eye bolt and links also but these disclosures were not completely developed as to exactly how to handle all the loads thru the joint. Johnson '092 also disclosed walls cast under the ceiling slab with the joint made by a bendable bar. This was subject to the same problems but in addition, resulted in a condition completely inaccessible for repair if something went wrong.

Verner U.S. Pat. No. 3,785,095 disclosed flat bars extending from the edges of both ceiling and wall slabs, with a substantial length of the bars embedded in the slabs as required to generate a cantilever for the hinge. Verner '095 also disclosed a slot in the wall portion of the hinge to assist in generating a clearance for rotation. To make this hinge work required extensive reinforcing, and was usable only for the condition of the walls being cast outward from the ceiling slab. The premise of the hinge was to keep the ceiling slab *off* from bearing on the wall slabs. This was used by present inventor on a twelve story building successfully, but cost a good deal of money, and was resisted by the engineers reviewing the design of the building for code compliance. It did provide a good pocket for grout under the wall, but this kind of connection is not adequate for current revised uniform building code standards, unless the edges of the walls are especially roughened to produce ¼ inch reveal. This is not practical.

Miram U.S. Pat. No. 3,789,455 disclosed a removable two piece hinge suitable for connecting ceiling slabs cast in the same plane as the wall slabs. A hinge member was secured to opposing edged of wall slab and ceiling slab, and the slabs had to be in perfect position and perfect spacing to make the connection. This resulted in the same problems as encountered in assembling ordinary precast slab construction, and was very difficult. It had the advantage of saving most of the cost of the hinge in that the hinge itself was reusable, but the cost of the hinge, and the cost of the labor to install, to remove, and the attendant anchor required to secure the wall made it uneconomical so far as present inventor knows. In addition, it was not adaptable to an underlying wall assembly being assembled to an overlying ceiling slab, and especially for interior walls.

Greenhalgh U.S. Pat. Nos. 3,527,008 and 3,600,870 disclosed cable lines inserted down thru hollow bore bolts to connect to walls hinged at the edge of a ceiling slab. This required outside access to the wall slab edge, and did not provide the means to make the connection from above the ceiling slab, nor a precise positioning of the wall slabs in the erected position. This relied on "winding up" the cable to bring the wall up to the ceiling slab. This is not adaptable to the needs of the present method of construction.

There are other various means of hingeably connecting ceiling slabs to wall slabs thru the use of some sort of bendable metal. Present inventor does not know of their being reduced to actual practice.

It is the object of the present invention to disclose a connection device that can be used with precast ceiling slabs, and wall slabs, and provide the means to easily assemble the slabs, and to have a tolerance to overcome errors in workmanship; and to provide the means to adjust the final position of the wall slabs in the erected position. It is a further objective to provide a pivot means located at the center of gravity of the wall when the wall is in a vertical position, to assist in the erection of the building.

It is a further objective to provide an accessible connection device which can be visable inspected, and which is adaptable to the nested slab configuration of ceiling slabs when the undersurface of the ceiling slab is not always in the same plane.

It is a further objective of the present invention to provide a connection where the connection to the pivot may be done by hand reaching down thru the access hole rather than 'fight' the problems of blind hinges where they are cast in place for interior underlying walls.

It is a further objective to eliminate connecting devices which have extensions beyond the surface of the slabs that interfer with casting, finishing, and are prone to the knocked out of line by the workmen during the casting operation.

It is a further objective to reduce the waiting time of the crane during erection by facilitating the means of the field work.

It is a further objective to disclose a design that is not subject to freezing by the grout that has penetrated the presently used types of Flat Bar hinges.

SUMMARY OF THE INVENTION

Briefly, the invention, *eliminates all parts of the hingeable connection* that would normally be cast integrally with, or bolted to the overlying ceiling slab in foldable slab constructed buildings, and *replaces such parts with an access hole.*

The access hole comprises a hole thru the ceiling slab and located in the footprint area of the wall to be lifted, and usually would occur two in number for each wall, and be located near the end of the wall. The access hole would include normal reinforcing bars extending along side of the hole, and for multistory buildings, would have at least one side or end provided with a metal plate extending the thickness of the ceiling slab. The connecting device comprises an elongated member inserted downward thru the hole when the hole is in position over hinge edge of the wall, and the elongated member is connected to a pivot means anchored to the edge of the wall, and the assembly of elongated member and pivot is such as to permit the edge of the wall to rotate under the ceiling slab when the ceiling slab is elevated, and the elongated member is prevented from the downward movement thru the access hole. In addition, the elongated member connection provides alone, or with the assistance of a guide tool, for the guidance of the ceiling slab into precise position when the ceiling slab is lowered onto the wall; The elongated member may be incorporated in the structure as a permanent connection according to certain variations in the design, or may be of a removable type for repeated use.

BRIEF DESCRIPTION OF THE DRAWINGS

FIG. 13 FIG. 2 type connection shown in installed position.

DESCRIPTION OF THE PREFERRED EMBODIMENTS

Figure 1:
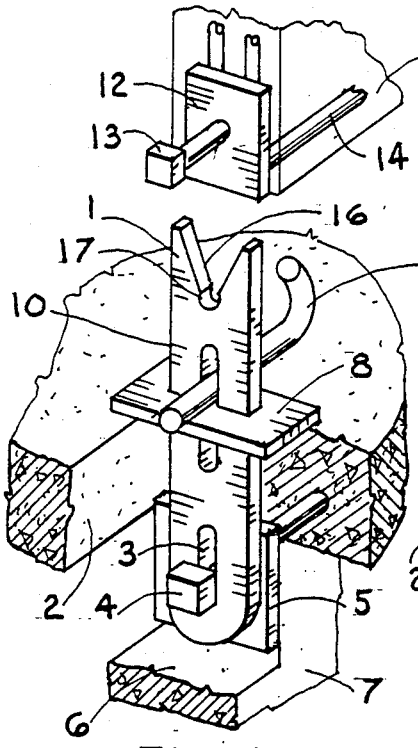
FIG. 1 Shows flat bar type connector thru access slot into notch in wall.

In FIG. 1, elongated flat bar member 1 inserted downward thru access slot 2 with slot 3 engaging pivot 4 securred to end 5 of notch 6 located in wall 7. The wall and slab are shown in fine line to emphasize the connection device. Flat bar 1 extends thru an opening in plate 8, and a bar is inserted thru slot 10 to limit the downward movement of the bar during the lifting. Plate 5 is anchored in wall at end of notch 6, and a bolt is threaded into it. A plate 12 is anchored in the next above wall slab, and is there secured with bars 14. A bolt 13 is threaded into plate 12, and as wall 15 is lowered, bolt 13 is guided by notch 16 into semicircular notch 17. It should be noted that that the length of the slots in the flat bar control the height of the top of the wall during the lift, so that this may be adjusted to that needed for grout placement on top of wall if this is required. The edges of the flat bar are supported by the sides of the access hole so that the wall position is under control at all times. This arrangement for the invention permits the forms to be fashioned without penetration of rebars, or cast in place members, and is very efficient form wise. It is easy to install, and is very simple remove should it be desired. If it is left in position, it serves to provide vertical continuity for the structure.

Figure 2:
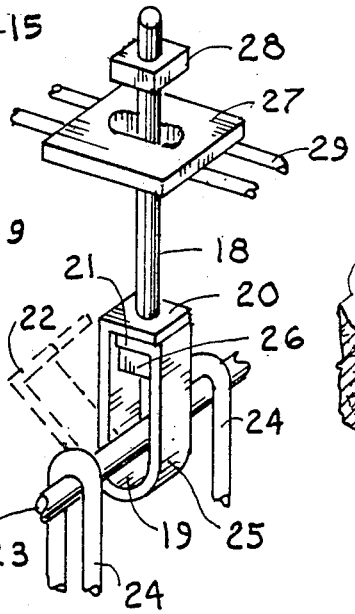
FIG. 2 Shows bolt type connector with bendable metal loop.

FIG. 2 shows elongated member 18 extending down to connect to a formed metal loop 19. Loop 19 is formed with sides 25 and ends 20 and 21, with bolt 18 threaded into a nut 26. Pivot 23 extends thru loop and is secured to wall slabs by reinforcing bars 24. Bolt 18 extends upward thru plate 27 resting on bars 29 which extend across access slot. In some codes, the examiners desire that such bars extend thru the connection area. Nut 28 limits the downward movement of the connector. This form of the connection device utilizes a pivot bar 23 extending across a notch in the wall slab, and this can be useful where additional shear transfer is required, and filling the access slot and the notch with concrete can be utilized for this purpose. Loop 22 is shown dotted 22, as it might be manufactured for later installation after the wall has been cast. This form of connection provides additional tolerance for imperfect workmanship, and provides for adjustment after erection.

Figure 3:
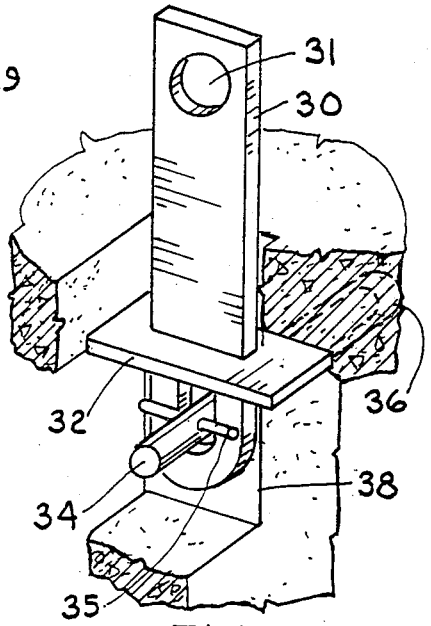
FIG. 3 Shows Flat Bar connector with plate to lift ceiling slab.

FIG. 3 shows flat bar 30 with lifting hole 31, to which lifting lines may be attached. Plate 32 is shown welded to flat bar 30, and positioned at the under surface of the ceiling slab; so that when the bar 30 is lifted, the ceiling slab is lifted. Pivot bar 34 is a simple dowel with friction fit into sleeve pocket 35 anchored into end edge 38 of wall slab. Pin 35 is shown thru pivot bar to resist flat bar sliding off. It should be noted that the end of the notch 38, could be the end edge of the wall.

Figure 4:
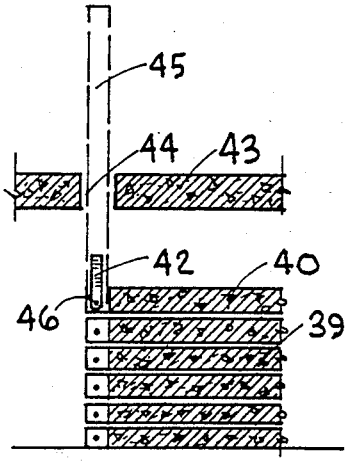
FIG. 4 Shows stack of walls with ceiling slab being lowered into position.

FIG. 4 shows six walls 39 as cast gang fashion in a stack, with a lifting connection as from FIG. 1, installed 42, and pivot bolt 46, to the side of notch in wall 40. A hollow tube 45, is shown inserted down thru access slot 44 and over connection flat bar 42, so that as ceiling slab 43 is lowered, it comes into a precise location desired in this method of assembly. It would normally be desired to utilize two such guides per ceiling slab located at opposite corners of the slab, to facilitate total assembly. The tube is reusable for the entire job.

Figure 5:
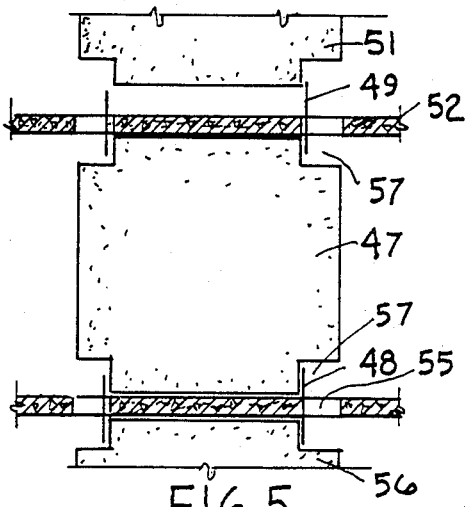
FIG. 5 Side elevation of wall with four corner notches and wall above being lowered into position.

FIG. 5 shows wall 47 in the erected position, with connection devices 48 extending thru access slots 55 providing continuity to wall 56. Wall 51 from next above module is being lowered onto slab 52, and will be guided by connection device 49 into accurate alignment. The notches 57 will be filled with cast in place concrete to provide shear blocks for the structure.

Figure 6:
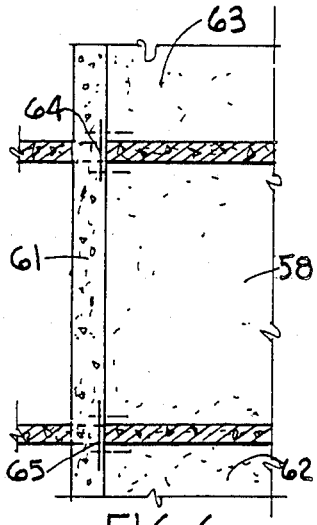
FIG. 6 Side elevation of erected wall with cast in place column.

FIG. 6 shows walls 58,62,63 in erected position with connection devices 64 and 65 in position. After the structure is erected, a cast in place column 61 is formed and cast which provides additional continuity thru the structure. Dowels may be provided to tie wall 58 to this column or wall 58 may extend into a groove in column 61, with an expansion filler material.

Figure 7:
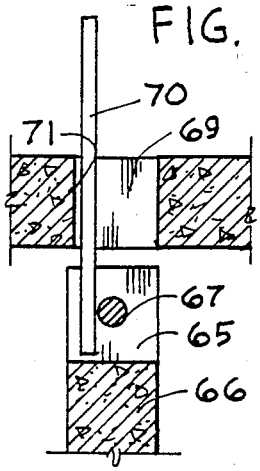
FIG. 7 Fragramentary view of wall and access slot.

FIG. 7 shows wall 66 being adjusted in position by use of a bar 70 applied against pivot bar 47. Plate 66 may be welded to plate 69 from above to secure joint.

Figure 8:
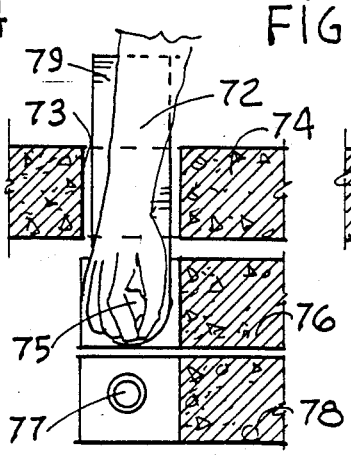
FIG. 8 Fragramentary view of hand installing bolt type pivot.

FIG. 8, shows hand installing pivot bolt thru access slot 73. A threaded insert 77 is shown in the lower wall, for the next assembly.

Figure 9A:
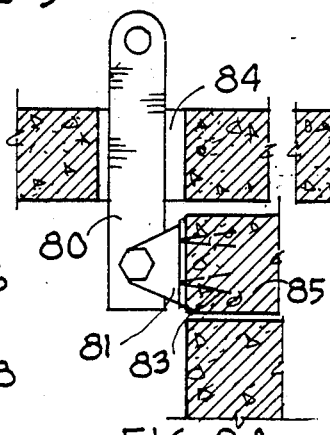
FIG. 9A and B Fragmentary view of bracket type pivot connection.
Figure 9B:
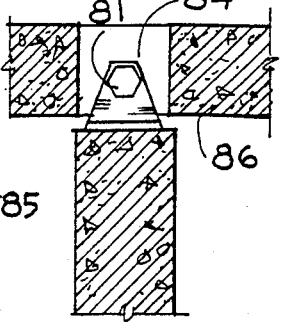

FIG. 9A shows a bracket 81 with flat bar 80 and pivot bolt 82, with bracket secured to the wall by bolts 83. When erected, bracket 81 guides the wall into the access slot 84. Flat bar 80 may be unbolted and reused if desired, or it may be incorporated into a vertical continuity tie.

Figure 10:
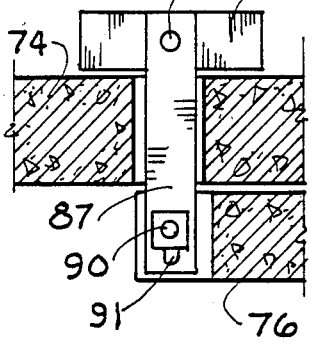
FIG. 10 Flat bar connector with bolted connected bridge over access slot.

FIG. 10 shows flat bar 87 with slotted hole 91 engaging pivot 90. Flat bar 88 bridges access slot, and a bolt 89 supports flat bar 87.

Figure 11:
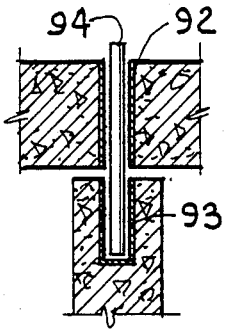
FIG. 11 Shows auxiliary dowel in sleeve to fix wall in position.

FIG. 11, shows a tube socket 93 cast in the edge of wall slab to receive dowel 94, inserted thru a sleeve 82 positioned in ceiling slab. Dowel would be inserted before lowering ceiling to bear on wall, and would assist in guiding ceiling when the flexible type of lifting connection is used.

Figure 12:
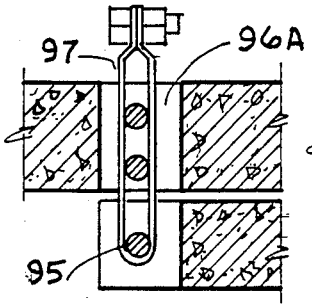
FIG. 12 Shows elongated connecting member formed from sheet metal strap.

FIG. 12 shows a strap 97 formed into an elongated loop around pivot 95 and secured with a bolt, and supported by the reinforcing bars extended thru access slot. There is adaquate room in the slot to insert this type of connector. Blocking may be inserted at 96A, to guide the wall into correct position.

Figure 13:
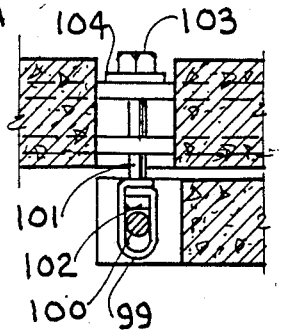

FIG. 13 shows a strap or sheet metal piece 99 formed around pivot 100, and bent over a nut 102 into which bolt 101 is threaded. A nut 103 on top of washer 104 privides support and permits lateral adjustment of the wall. This is a section of FIG. 2.

Figure 14:
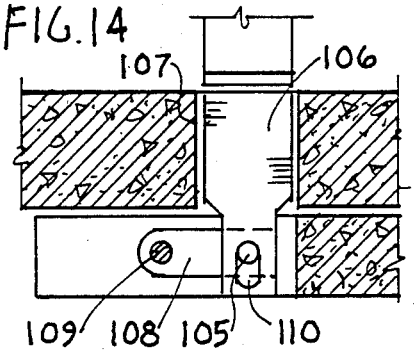
FIG. 14 Application of invention to offset hinge lifting

FIG. 14 ahows a flat plate 106 supported laterally by the sides of access slot 107 with slot 110 engaging short bolt 105 which engages flat bar 108 which engages pivot bar 109 which extends into sides of the notch. This fig is to show the adaptation of the present invention to offset hinge requirements for certain casting configurations.

Figure 15:
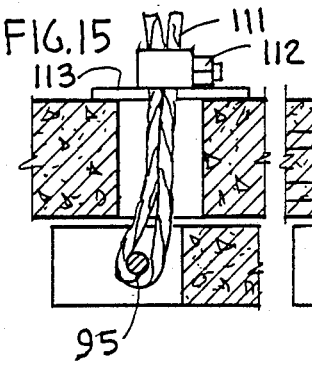
FIG. 15 Shows elongated member of connection fashioned with cable.
Figure 16:
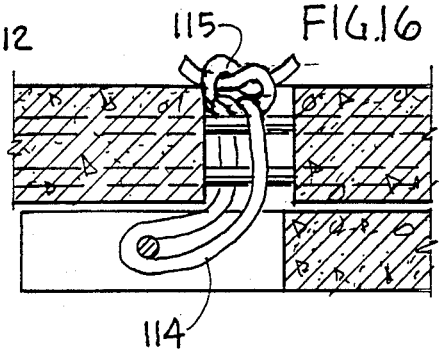
FIG. 16 Show application of a rope to form elongated connection member.

FIGS. 15 and 16 show an application of materials as may be the only ones available in third world countries, to apply the present invention with the access slot and the elongated connection members. This is not a preferred type of arrangement but does illustrate the application of the patent to such areas.

Figure 17:
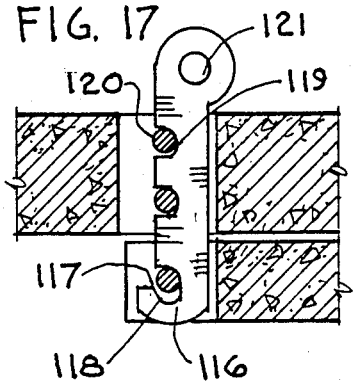
FIG. 17 Shows removable type lifting connector.

FIG. 17 discloses flat bat 116 shaped to provide a slot 118 with side access 117, and notches 119 engaging reinforcing bars 120 extended longitudinally in access slot. This flat bar 116 would be installed longitudinally and rotated 90 degrees to the shown position so that the edge is supported by the access slot. The upper end is shown extended for lifting.

Figure 18:
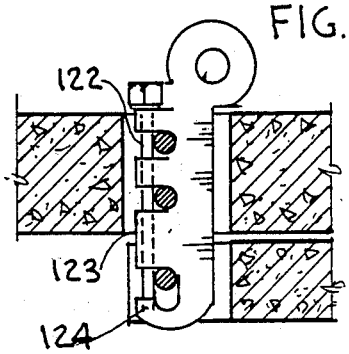
FIG. 18 Shows removable type lifting connector with security bolt.

FIG. 18 shows the addition of a tube edge 123 on a shaped bar, which would provided added security to the lifting device, and would overcome the concern of some contractors.

Figure 19:
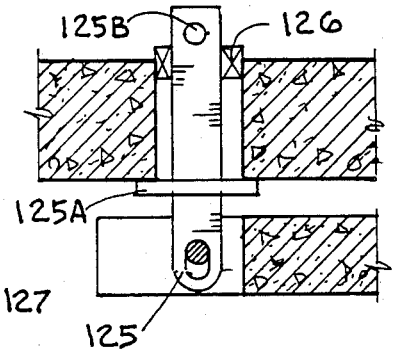
FIG. 19 Shows elongated flatbar to pick up low wall in nested slab application.

FIG. 19 discloses flat bar 125 with a lifting plate 125A and spacing shims 126 to adjust the lateral position of flat bar. Note that the flat bar can easily be adjusted laterally to accomodate bad positioning of the ceiling slab over the wall slab. Lifting hole 125B accomodates a lifting line. This figure also illustrates the condition of a wall slab being in a lower plane at the time of lift as may occur in the nested slab configuration. Note also that the notch 127 is larger than ordinary, to permit the end of the wall to swing up near the underside of the ceiling slab.

Figure 20:
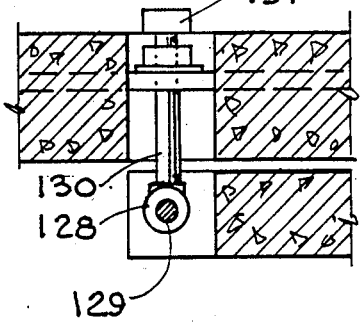
FIG. 20 Shows bolt type elongated member threaded into "T" type pivot.

FIG. 20 discloses a threaded "T" pivot 128 on pivot 129 with bolt 130 supported on reinforcing bars extended across access slot. Nut 131 can be screwed down after erection to secure joint.

Figure 21:
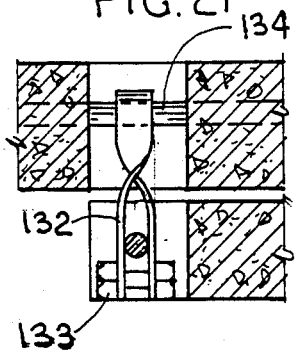
FIG. 21 Shows alternate position of strap type elongated member.

FIG. 21 discloses the elongated member 132 fabricated of a strap and twisted to accomodate the pivot bar being at right angles to reinforcing bars extending across access slot. The bolt is shown at the lower end of the strap as an alternate location to that shown FIG. 12.

Figure 22:
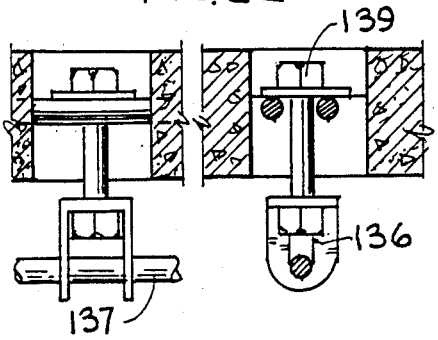
FIG. 22 Shows alternate pivot connection with shaped metal channel.

FIG. 22 shows an alternate method for fabricating the connection to a pivot bar.

Figure 23:
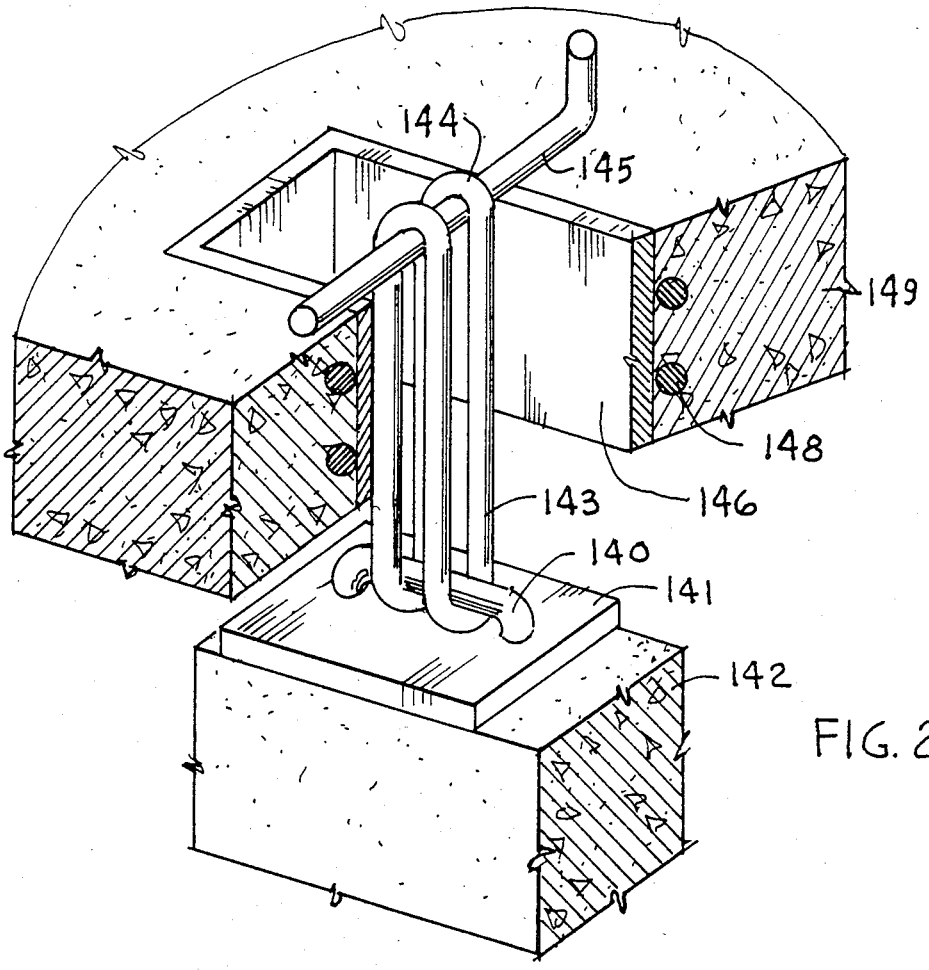
FIG. 23 Shows cable loop continuous under pivot bar and over lift bar.
Figure 24:
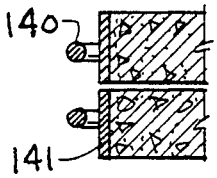
FIG. 24 shows stack of walls with loop type pivot bar.

FIG. 23 shows pivot loop 140 secured to plate 141 which is anchored to wall 142. A continuous loop 143 is formed of a flexible cable which is threaded thru slot 146 down thru pivot loop 140 and back up to the top of ceiling slab 149 where is is secured by bar 145 bridging access slot 146. Fig shows an optional plate 147 extending around the access slot as is desirable in multi story building. Refering to FIG. 24 thru 28, FIG. 24 shows two walls in stack arrangement with pivot loop in position. The thickness of plate 142 is the same as the form for the edge so that it may be formed flush without penetration of a hole thru the form.

Figure 25:
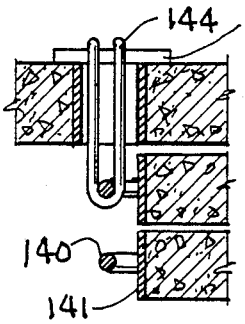
FIG. 25 Shows ceiling slab with access slot over walls in FIG. 24.

In FIG. 25, the ceiling slab has been positioned over the edge of the wall slab, and cable 144 inserted down thru the access slot, thru loop 140 A and back up to top of slab, where 145 has been inserted thru the end of the loop to secure it.

Figure 26:
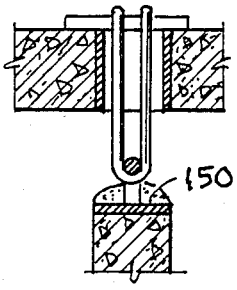
FIG. 26 Shows wall of FIG. 25 lifted with grout topping in place.

FIG. 26 shows the wall lifted and the position of the ceiling slab and wall, and how grout 150 may be buttered into position.

Figure 27:
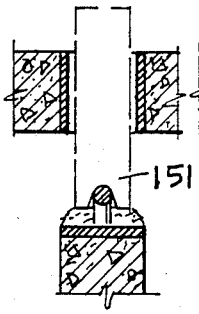
FIG. 27 Shows a guide tool in position. (Lifting cable not shown for clarity).
Figure 28:
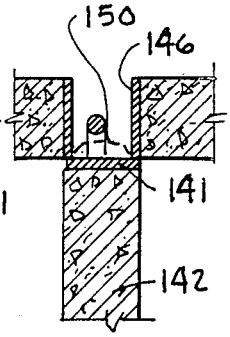
FIG. 28 Shows ceiling slab lowered to bear on wall.
Figure 29:
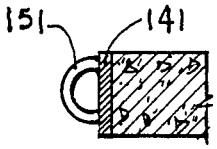
FIG. 29 Shows alternate position of loop type pivot bar.
Figure 30:
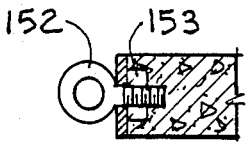
FIG. 30 Shows eye type pivot bar.
Figure 31:
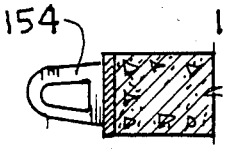
FIG. 31 Shows plate type loop pivot bar.
Figure 32:
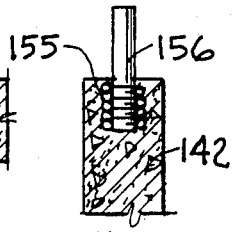
FIG. 32 Shows auxiliary dowel threaded into top of wall for added reinforcement.

In FIG. 27, a guiding flat bar with a notch in the lower end 151, is inserted down thru access slot, to engage pivot loop. When the ceiling slab is lowered, ths tool is forced upward thru slot, and at the same time guides the loop perfectly into the access slot. Here the plate 141 supports plate 146, providing a space the thickness of the plate 141 for the grout, and accomodation for any crookedness of the edge of the wall slab. Plates 146 and 141 may be welded if desired. FIGS. 29, 30, 31 show alternate methods of fabricating pivot loop. The common factor is that the loop fit within the access slot, the plate 141, be the thickness of the wall, and the access slot be narrower in width that the wall thickness, and that a guidance tool or bar be used to facilitate wall alignment during the ceiling lowering operation.

The novelty of the invention lies in the installation of the hingeable connection thru the slab to effect a hingeable type connection, and the utilization of the access slot for alignment of the wall position, and the added use of providing for a shear block for the structure. It is really part of the copending application Ser. No. 519,082 in which the many advantages of this type of connection are cited. It is believed that the present invention discloses significant improvement to connection devices for use in foldable construction buildings, and petitioner requests favorable consideration.

What is claimed is:

1. In the method of constructing buildings with folding slabs, a connection device for connecting overlying ceiling slabs to the hinged edge of the underlying wall slabs after said slabs have been cast, said connection comprising, at least one access slot thru said ceiling slab, minimum width of said slot equal to the thickness of said wall slab, and said access slot located in said ceiling slab according to the footprint location of said hinge edge of said wall slab in the erected building, and in addition, an elongated connecting member, said member less in width than said access slot, and thickness of said wall; and said member capable of being installed from above said overlying slab down thru said access hole to engage a pivot means located in edge of said underlying wall slab, and in addition, a restraining means provided to limit the vertical movement of said elongated member from passing downward all the way thru said access slot, and;

means provided in said elongated device to permit said overlying slab to move upward, and then said elongated member to engage said pivot means, and to elevate said pivot means and permit said wall to rotate to a vertical dependent position, and lowering said ceiling slab causes said wall to come to bear on a supportive surface, and said elongated member to guide said ceiling slab to a precise position bearing on said wall.

2. According to claim 1 wherein said means of restraining vertical movement of said elongated member, comprises a bridge bar extending across said slot above top surface of said overlying slab, and said bridge bar is secured to said elongated member, and a slot in lower end of said elongated member permits vertical movement of said elongated member before pivot bar is engaged.

3. According to claim 1 with the addition of a slotted bridge plate extending across said access slot and resting on top of said overlying slab, and said elongated member extends down thru said slotted bridge plate, and in addition, an elongated slot in upper end of said elongated member, and a support bar extends thru said elongated slot and is supported on top of said bridge plate.

4. According to claim 1, wherein said elongated member comprises a flat bar, and in addition, an elongated slot in lower end of said flat bar engages a pivot bar embedded in said underlying wall slab, and said slot is of such length to permit overlying slab to move up and away from underlying wall slab a distance to permit upper edge of underlying wall slab to rotate freely under said overlying ceiling slab.

5. According to claim 1 wherein said elongated member comprises a flat bar, and in addition, an extension of said flat bar extends above the upper surface of said overlying ceiling slab, and in addition, a "V" slot in upper end of said extension, appex of said "V" slot shaped to a round recess the diameter of bolt next mentioned, and in addition a bolt embedded horizontally and parallel to lower edge of next above wall slab, in said wall slab, and said "V" slot guides bolt and lower edge of next above wall slab into precise position during erection procedure.

6. According to claim 1, with the addition of a hole thru the said elongated member, said hole located near the lower end of said elongated member; and a bolt is threaded thru said hole and into edge of said underlying wall slab, and said bolt comprises a pivot bar for said connection.

7. According to claim 6, with the addition of a notch located at the end of the hinged edge of said underlying wall slab, and said bolt is threaded into side edge of said notch.

8. According to claim 1 with the addition of a notch located in the hinged edge of said underlying slab, and in addition a pivot bar embedded at mid depth of said underlying slab, extends across said notch to engage said elongated member.

9. According to claim 1, wherein said pivot means comprises a threaded member secured to side of notch in edge of said underlying slab, said securing still permitting rotating of said threaded member, and said elongated member comprises a bolt threaded downward thru said access slot to engage said threaded member.

10. According to claim 1, wherein said restraining means comprises at least two spaced apart reinforcing bars extending across said access slot in said overlying slab, and in addition a slotted plate washer resting on top of said bars, and said elongated member extends thru said slotted washer, and a bar extending thru said elongated member above said slotted washer limits downward movement of said elongated member.

11. According to claim 1, wherein said elongated member comprises an elongated loop with at least one open end, and said elongated loop is inserted thru said access slot to engage a pivot bar in said underlying wall slab, and to engage at least one restraining bar extending across said access slot, and said open end of said loop is then secured to form a closed loop, and length of said loop is such as required to permit movement of said pivot bar.

12. According to claim 1, wherein said pivot means comprises a short "U" shape fabricated from flat stock, ends of said "U" formed at right angles to legs of said "U", and said ends provided with centered holes, and depths of said "U" of such dimension to accomodate a pivot bar in said underlying wall slab, and in addition a nut placed between said ends and said pivot bar, and said "U" is placed around said pivot bar, and said nut is positioned between said ends and said pivot bar, and said elongated member comprises a threaded member which is threaded down into said nut.

13. According to claim 1 wherein said overlying slabs and said underlying slabs have been cast separately, and an overlying slab is being assembled with its associated underlying wall slabs, and said elongated member has been engaged to said pivot means and has been positioned in a vertical position, the addition of a hollow tube inserted downward thru said access hole in said overlying slab and over said elongated member, and said overlying slab is lowered onto said underlying slab and said tube is removed and said restraining means secured.

14. According to claim 1 where a separately cast overlying slab is being lowered onto and assembled with its associated underlying wall slabs, the addition of at least two flat bar guides inserted downward thru at least two of said access slots, said flat bar guides with a configuration at their lower end to engage said pivot means in said underlying wall slab, and said guides are engaged with said pivot means, and said guides bring said ceiling slab into precise position as it is lowered onto said underlying wall slabs.

15. According to claim 1 wherein said pivot means comprises a pivot bar extending across a notch provided in edge of said underlying wall slab, and said elongated member comprises a flat bar, said flat bar shaped with a vertically elongated hook profile at its lower end, said hook suitable to engage said pivot bar, and in addition, said means of restraining vertical movement of said elongated member comprising at least one reinforcing bar extending across said access slot in said overlying slab, and in addition, at least one cutout in edge of said flat bar facing same direction as said hook, and said cutout of such size as to receive said reinforcing bar, and dimensions of said flat bar are such that it may be inserted downward between said reinforcing bar and side of said access slot, and then rotated 90 degrees so that hook engages said pivot bar, and said cutout engages said reinforcing bar, and opposite edge of said flat bar is supported against side of said access slot.

16. According to claim 5 with the addition of a tubular edge along the cutout edge of said flat bar, and a threaded connection at the bottom end of said edge at the leg of said hook, and in addition, a bolt threaded downward thru said tubular edge and threaded into said threaded connection, secures said flat bar to said pivot bar and said reinforcing bar.

17. According to claim 1 wherein said pivot means comprises a bolt threaded thru a bracket secured to edge of said underlying wall slab, said bolt positioned at mid depth of said underlying slab, and said bolt parallel to plane of said wall slab, and said bracket of such dimension as to fit within said access slot and to guide said ceiling slab into a precise position when said ceiling slab is lowered onto said wall.

18. According to claim 1 wherein said pivot means comprises a pivot bar across a notch provided in edge of said underlying wall slab, and said elongated member comprises a cable loop, and one end of said loop is threaded downward thru said access slot, around said pivot bar, and back up to top of said overlying slab, and in addition, a restraining bar is threaded thru the ends of said loop and said restraining bar supported on top surface of said overlying slab, and overall length of said loop is that required for required movement of slabs.

19. According to claim 1, wherein said pivot means comprises a rigid loop attached to a bearing plate secured to top edge of said underlying wall slab, and in addition support plates are secured to the sides of said access slot in said overlying slab, and said rigid loop fits between said support plates and said bearing plate supports said support plates.

20. According to claim 1, wherein said pivot device comprises a pivot bar embedded in said underlying wall slab, said bar located at some distance from said hinged edge of said underlying wall slab and positioned within a notch extending from edge of said wall slab to a position under said access slot, and in addition, a link connection extending from said pivot bar over to and under center of said access slot, and means of connecting lower end of said elongated member to end of said link, and elevating said ceiling slab elevates said link and said bar to swing said underlying wall over to and under said access slot.

* * * * *